US007356958B2

(12) United States Patent
Weir

(10) Patent No.: US 7,356,958 B2
(45) Date of Patent: Apr. 15, 2008

(54) FORWARD RAIL MOUNTED TRIGGER MODULE

(76) Inventor: Robert F. Weir, 20809 Clydesdale Rd., Chicago Park, CA (US) 95712

( * ) Notice: Subject to any disclaimer, the term of this patent is extended or adjusted under 35 U.S.C. 154(b) by 0 days.

(21) Appl. No.: 10/906,291

(22) Filed: Feb. 12, 2005

(65) Prior Publication Data

US 2006/0048424 A1 Mar. 9, 2006

Related U.S. Application Data

(60) Provisional application No. 60/521,061, filed on Feb. 12, 2004.

(51) Int. Cl.
*F41A 19/00* (2006.01)

(52) U.S. Cl. ..... 42/69.01; 42/42.02; 42/90; 89/136; 89/27.11; 89/27.3

(58) Field of Classification Search ..... 42/69.01, 42/42.02, 90; 89/136, 27.11, 27.3
See application file for complete search history.

(56) References Cited

U.S. PATENT DOCUMENTS 2,627,132 A * 2/1953 Dolgacius ..... 42/118
3,828,458 A 8/1974 Skone-Palmer ..... 42/69
4,514,923 A * 5/1985 Teel ..... 42/69.01
4,601,123 A 7/1986 Swearengen et al. ..... 42/72
4,663,876 A 5/1987 Reaume ..... 42/71.01
4,677,781 A 7/1987 Lee ..... 42/70.01
4,685,379 A * 8/1987 Troncoso ..... 89/136
4,869,008 A 9/1989 Rasmussen ..... 42/71.01
4,986,019 A 1/1991 Dennis, Jr. ..... 42/69.01
5,448,940 A 9/1995 Schuetz et al. ..... 89/185
5,780,762 A * 7/1998 Kobayashi ..... 89/140
6,526,683 B1 3/2003 Crandall ..... 42/40
6,807,763 B1 * 10/2004 Leung ..... 42/71.01

* cited by examiner

*Primary Examiner*—J. Woodrow Eldred
(74) *Attorney, Agent, or Firm*—Geoffrey E. Dobbin

(57) ABSTRACT

The present invention is a rail mounted forward trigger mechanism featuring in-line linkage between the primary and secondary triggers. Access to adjustment features provides adjustability while simultaneously allowing the mechanism to remain installed. The linkage is also hinged and mounted coaxially with the disconnect pivot point of a weapon, thereby allowing field stripping the weapon without removing the linkage. Connection to the primary trigger of the host weapon is ideally accomplished with a can and roller assembly for smoother and more controlled actuation. An electrical embodiment is also disclosed.

12 Claims, 5 Drawing Sheets

FIG. 4a
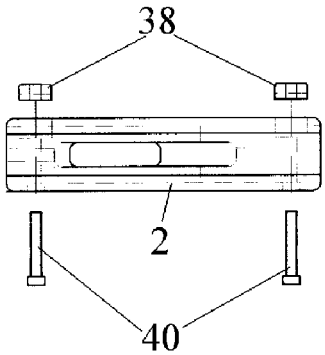
FIG. 5a
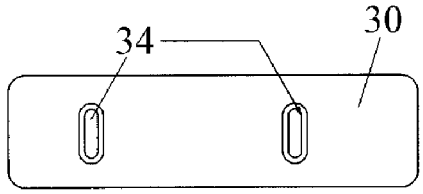
FIG. 5b
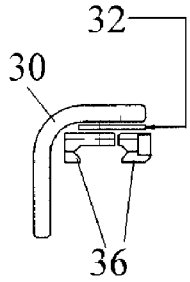
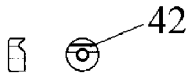
FIG. 4b

FORWARD RAIL MOUNTED TRIGGER MODULE

FIELD OF INVENTION

The present invention relates to improved gunstocks and firing mechanisms and more particularly relates to an attached module that locates a secondary trigger in front of the action of a firearm and allows for shortening the weapon by removal of the conventional stock, thereby allowing the weapon to be more compact and easier to handle and hold on target.

BACKGROUND OF THE INVENTION

Since firearms were developed, there have been many methods and devices developed for modifying a firearm and adapting such weapons to multiple use variations. One such variation is a shortening mechanism for a long gun, either rifle or shot gun, allowing it to be held on target easily and increase maneuverability and storage capabilities of the weapon. These devices, commonly called "bull-pups" typically involve installing a mechanism with a secondary trigger mounted so that the trigger is in front of the action of the weapon and mechanically linking the secondary and primary triggers. The weapon's stock is then removed and replaced, usually with a component of the new firing mechanism. The resulting weapon is commonly found to be better balanced than the original, unmodified weapon and is, therefore, much easier to handle. However, there are a number of disadvantages with the modules in the prior art. They tend to require extensive modification to the weapon to support the bull-pup module on the weapon and restrict the option of disassembling the weapon as the modules also tend to block the disassembly pivot point of the base long gun. They also have to be exact in their linkage of the two triggers. Any linkage adjustment tends to be difficult or impossible. Positioning of the linkage on the primary trigger must also be exact, as the linkage merely pushes the trigger and misplacement and extra "play" in the linkage can lead to poor trigger capabilities or misfire.

While the prior art inventions accomplish their individual objectives, they do not describe a rail mounted trigger mechanism; nor do they feature a direct, in-line hinged linkage between the secondary and primary triggers allowing for field disassembly of the weapon without removing the module. Neither do they describe an easily adjusted mechanism to eliminate play between the triggers; nor do they disclose a cam and roller mechanism to improve interplay between the secondary and primary triggers. In this respect, the trigger mechanism according to the present invention departs substantially from the usual designs in the prior art. In doing so, this invention provides a lower profile, rail mounted forward trigger module. Further, the cheek rest is also easily mounted to the long gun by clamping to long guns receiver dovetail rails (including 1913 mil spec. rails, also known as Picatinny rails, or Weaver rails).

SUMMARY OF THE INVENTION

In view of the foregoing disadvantages inherent in the known types of forward trigger mechanism, this invention provides an improved forward trigger module. As such, the present invention's general purpose is to provide a new and improved trigger module that will mount directly upon a standard attachment rail of a weapon, feature a hinged, adjustable, in-line linking mechanism to actuate the primary trigger, and a cam module connection of the linkage to the primary trigger with a cheek rest mounted on a receiver mounting rail.

To accomplish these goals, the module comprises a mounting rail interface with a built in trigger assembly, complete with a grip, a safety mechanism, and fire selector switch (if included). A hinged linkage bar is attached to the trigger assembly and is directed through the module, towards the primary trigger, to which the linkage is clamped with a cam and roller assembly. The primary trigger is covered with access shielding and the butt stock of the weapon is replaced with a shorter butt stock and a rail mounted cheek rest is added to the weapon. An adjustment screw is provided to lengthen or shorten the overall length of the linkage and eliminate slack between the triggers. The hinge in the linkage bar is positioned coaxially with the disassembly pivot point of the weapon.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 4*a* is a top plan view of the trigger module and connecting hardware, with one round plug clamp in section.

FIG. 4*b* is a front and side plan view of the round plug clamps in FIG. 4*a*.

FIG. 5*a* is a top plan view of the cheek rest.

FIG. 5*b* is a rear plan view of the cheek rest.

DETAILED DESCRIPTION OF THE PREFERRED EMBODIMENT

Figure 1:
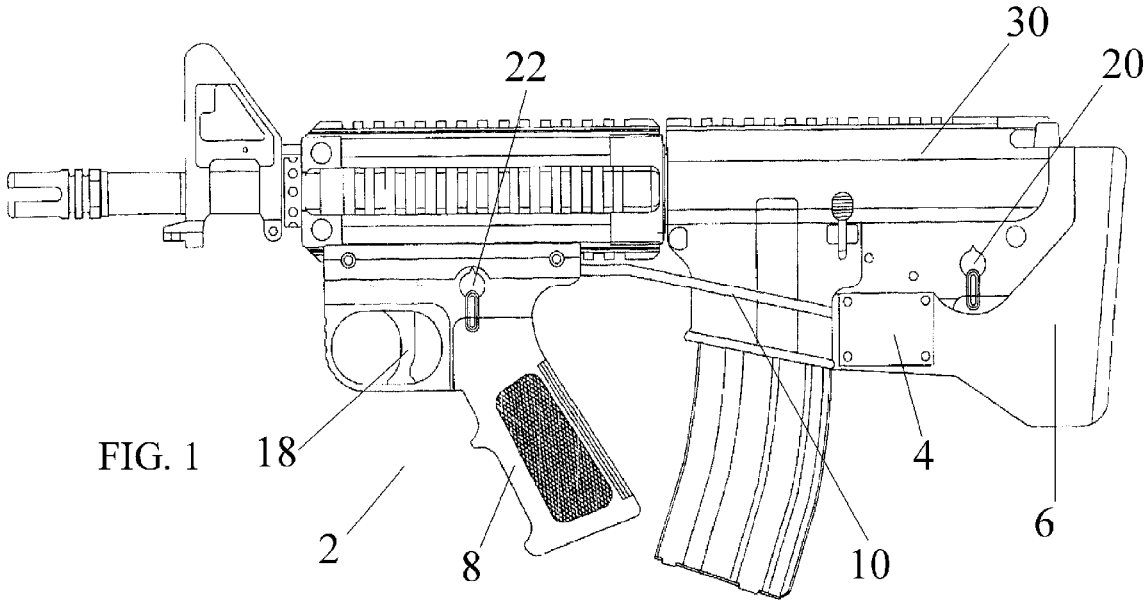
FIG. 1 is a left plan view of the trigger mechanism installed on a weapon.
Figure 2:
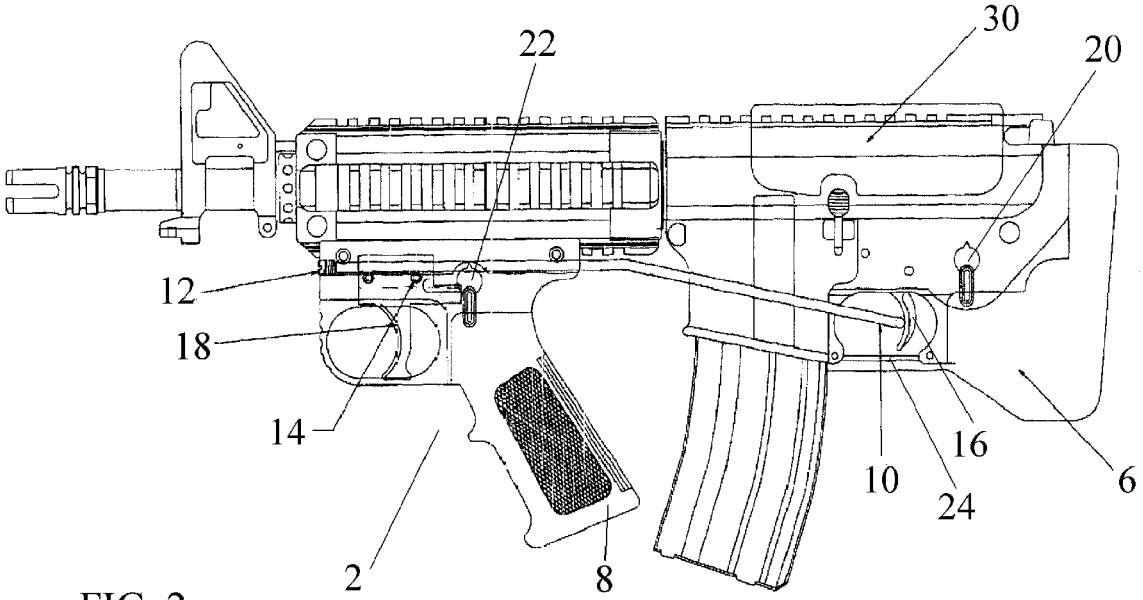
FIG. 2 is the weapon of FIG. 1 in a partial section, with the important components of the mechanism labeled.

With reference now to the drawings, the preferred embodiment of the trigger module is herein described. The module, as seen in FIG. 1, for entire conversion, consists of 5 major components necessary to complete the weapon: a rail mounted trigger module 2, a pivoting linkage 10, a cam roller trigger actuator 28, a short butt stock 6 and a rail mount cheek rest 30. The first component is the trigger module 2. This includes the actual trigger mechanism so as to emulate the primary trigger 16 and surrounding area of the unmodified weapon. The trigger module 18 should include a safety mechanism 22 and, could possibly include the selector switch for semi-automatic rifles. The final component of the trigger module is the mounting component, located above the linkage 10 and trigger 18 components. This component may be a standard clamp-style interface for dove tail rails, which are standard for the industry and are usually mounted on the barrel, upper receiver and stock of a rifle. The interface is shown in FIG. 4*a*. Access holes also provide adjustment of the screws holding the mounting component together on the rail.

In assembly, these parts would be constructed as the original weapon components, except that the trigger mechanism 18 is attached to a hinged linkage bar 10 that extends through the trigger module 2 and attaches to the primary trigger 16. The primary trigger 16 is covered 4 after assembly to reduce the incidence of accidental discharge. Linkage component also includes an adjustment screw 12 at the fore end, opposite the primary trigger, to lengthen or contract the overall length of the linkage bar, thus reducing play between the triggers. Access ports 14 are provided so that the linkage bar 10 may be adjusted relative to the trigger mechanism 18, thereby adjusting the Length of Pull (LOP) and without removing the entire mechanism. A cheek plate 30 and shorter stock 6 are then added to the weapon to complete the modifications.

Figure 3:
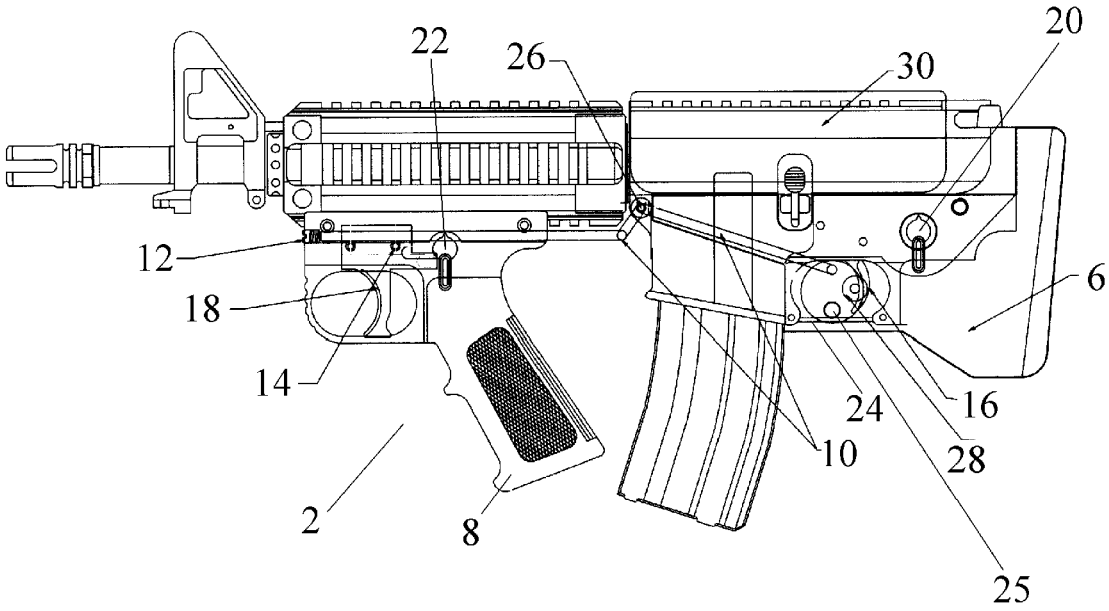
FIG. 3 is the weapon of FIG. 1 utilizing the cam roller and hinged linkage embodiments.

Numerous improvements may be made to the standard embodiment. The first, shown in FIG. 3, is the location of linkage pivot hinge at the location of the weapon's disassembly pivot pin. The position of the hinge 26 is advantageous as the weapon may be field stripped for maintenance or repair without removing the linkage bar 10. Likewise, a cam roller 28, mounted on trigger guard 24 with pivot pin 25, may be utilized to actuate primary trigger 16. Use of the cam roller trigger actuator 28 provides additional leverage for an easier and smoother pull. Primary safety 20 may be linked to secondary safety 22 through means similar to that described in this application or through a common rack and pinion assembly so that actuation of the secondary safety 22 actuates primary safety 20. Cheek rest 30 serves as a blast deflector and may be of any logical shape and should be horizontally and vertically adjustable. As shown in FIGS. 5*a* and 5*b*, adjustment slots 34 and spacers 32 are provided to adjust cheek rest's position relative to clamp 36 and, therefore, the weapon. FIGS. 4*a* and 4*b* show the use of round clamp plugs to hold bolts 40 in place, thereby holding the trigger module on the rail of the weapon. Slots 40 are provided for a sure interface with the weapon's rail.

Figure 6:
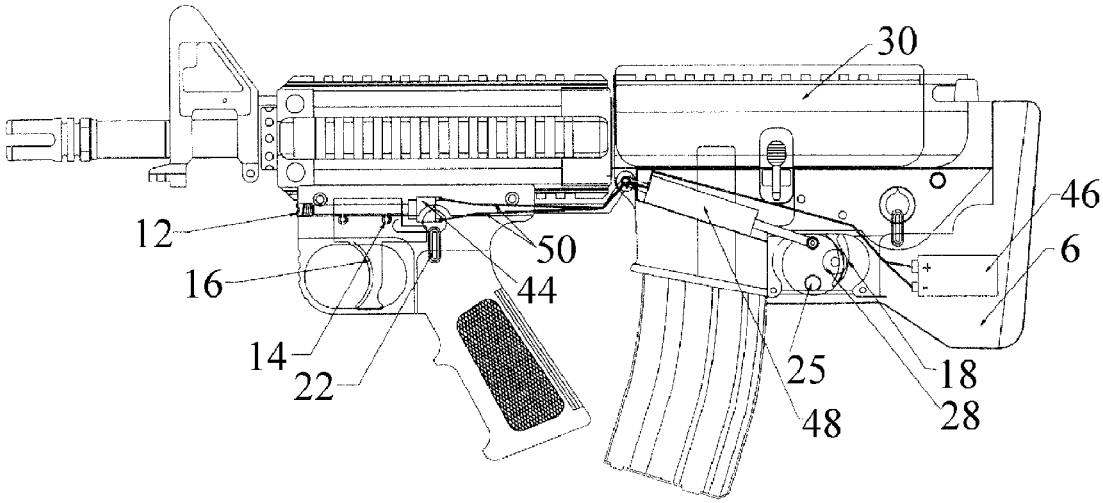
FIG. 6 is the weapon of FIG. 1 in a partial section, utilizing the electrical embodiment.

FIG. 6 details an electronic embodiment of the trigger module. Instead of linkage bar 10, the module further comprises an electronic switch 44 and power source 46 connected with wire 50. When actuated, switch 44 feeds power to solenoid 48 that actuates primary trigger 16.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A forward, rail mounted trigger module comprising:

a rail mounting assembly;

a trigger component, said component further comprising:

a trigger having a linkage mount disposed on an upper end of the trigger;

a safety mechanism in mechanical association with the trigger; and a grip; and a linkage bar, connected to the linkage mount and extending through the module to a rearward position of the module;

wherein, the linkage bar is connected to a primary trigger of a host weapon, thereby allowing a user to fire a weapon using the module's trigger.

2. The module of claim 1, further comprising an adjustment screw located at a fore end of the linkage bar, opposite the trigger, said screw accessible to a user without removing the module from the host weapon.

3. The module of claim 2, further comprising access at least one access hole, allowing a user to tighten or loosen at least one screw connecting the linkage bar to the linkage mount without removing the module from the host weapon, the linkage bar being in a slidable relationship with the linkage mount within the module when said screw is loosened.

4. The module of claim 1, the linkage bar further comprising two pieces, connected by a hinge.

5. The module of claim 4, the hinge of the linkage bar being coaxial with a disassembly pivot point on the host weapon.

6. The module of claim 1, the linkage bar further comprising a cam roller mounted within a trigger guard of the host weapon, said roller abutting both the trigger guard and the primary trigger, wherein the cam roller pushes the primary trigger when actuated by the linkage bar.

7. The module of claim 1 further comprising a cheek rest mounted upward and rearward of the module and said cheek rest also comprising an integral blast deflector.

8. The module of claim 7, the cheek rest attaching to host weapon receiver on a mounting rail.

9. The module of claim 8, the mounting rail being a dovetail rail selected from the set of rails consisting of: a Weaver rail and a Mil. spec 1913 utility rail.

10. The module of claim 7, the cheek rest being adjustable horizontally and vertically in relation to the module.

11. The module of claim 1, the safety mechanism of the module being mechanically associated with a primary safety mechanism of the host weapon, thereby activating said primary safety mechanism when the module's safety mechanism is actuated.

12. The module of claim 1 wherein the rail mounting assembly is connected to a mounting rail of the host weapon via round plug clamps.

* * * * *